US005292262A

United States Patent [19]

Endo et al.

[11] Patent Number: 5,292,262

[45] Date of Patent: Mar. 8, 1994

[54] ELECTRICAL CONNECTOR WITH REAR HOLDER

[75] Inventors: Takayoshi Endo; Tamio Watanabe; Keishi Jinno, all of Shizuoka, Japan

[73] Assignee: Yazaki Corporation, Tokyo, Japan

[21] Appl. No.: 88,587

[22] Filed: Jul. 9, 1993

Related U.S. Application Data

[63] Continuation of Ser. No. 961,262, Oct. 15, 1992, abandoned.

[30] Foreign Application Priority Data

Oct. 18, 1991 [JP] Japan ..... 3-271100

[51] Int. Cl.[5] ..... H01R 13/514

[52] U.S. Cl. ..... 439/752; 439/595

[58] Field of Search ..... 439/595, 752

[56] References Cited

U.S. PATENT DOCUMENTS

| | | | |
|---|---|---|---|
| 4,721,482 | 1/1988 | Fukuda et al. | 439/595 |
| 4,867,712 | 9/1989 | Kato et al. | 439/752 |
| 4,946,399 | 8/1990 | Kawashima | 439/752 |
| 5,066,252 | 11/1991 | Kato et al. | 439/752 |
| 5,076,806 | 12/1991 | Hotea et al. | 439/595 |
| 5,120,269 | 6/1992 | Endo et al. | 439/752 |
| 5,141,452 | 8/1992 | Yoneda et al. | 439/752 X |
| 5,147,222 | 9/1992 | Hotea et al. | 439/757 X |

FOREIGN PATENT DOCUMENTS 2-49656 12/1990 Japan .
2-61783 12/1990 Japan .

*Primary Examiner*—Eugene F. Desmond
*Attorney, Agent, or Firm*—Armstrong, Westerman, Hattori, McLeland & Naughton

[57] ABSTRACT

The connector consists of a connector housing with terminal accommodating chambers formed therein and a rear holder integrally joined to the housing by hinge straps. The housing has in an outer peripheral wall thereof openings extending to the terminal accommodating chambers, and the rear holder includes terminal locking projections insertable into the terminal accommodating chambers through the openings. The rear holder is fittable on the housing in two steps of a preliminarily engaged state and a fully engaged state. In the preliminarily engaged state, the terminal locking projections are located out of movement paths of the terminal lugs in the terminal accommodating chambers and in the fully engaged state, the terminal locking projections are located in the movement paths to prevent the terminal lugs from slipping off from the rear of the terminal accommodating chambers. The above structure leads to prevention of damages to the hinge straps during transportion and the like.

10 Claims, 9 Drawing Sheets

ELECTRICAL CONNECTOR WITH REAR HOLDER

This application is a continuation of application Ser. No. 07/961,292 filed Oct. 15, 1992, now abandoned.

BACKGROUND OF THE INVENTION

1. Field of the Invention

The present invention relates to an electrical connector having a rear holder joined to a housing thereof by resilient hinge straps for doubly preventing terminals inserted in the housing from slipping off from its rear.

2. Description of the Prior Art

An electrical connector with a rear holder is disclosed in Japanese Patent Publication Specification No. 61783/1990 in which the rear holder is joined to a housing by means of resiliently elastic lengthy hinge straps so that at mounting of the rear holder on the housing and its demounting therefrom stresses are not concentrated at end portions or intermediate portions of the hinge straps, thereby to preclude cutting of the hinge straps on repeated mounting and demounting of the rear holder.

Shown in FIGS. 14 to 16 is the above prior art. In the electrical connector, formed in a housing a are terminal accommodating chambers b, each of which has a resilient locking arm d projecting from its inner wall for preventing a terminal lug c from rearwardly slipping off. Rear holder engagement openings f extending to the respective terminal accommodating chambers b are formed in an outer peripheral wall e of the housing a, to which a rear holder i is connected by resiliently elastic lengthy hinge straps j. The rear holder i is composed of a base plate g and terminal locking projections h formed on the under surface of the base plate g for insertion into the rear holder engagement openings f. Each terminal locking projection h has a step portion k which, when the locking projection h is inserted in the associated engagement opening f, engages the rear end of the outer peripheral wall e for preventing the rear holder's front portion from being lifted. The rear holder i is provided with arms m including claws l that engage the exterior of the housing a for preventing the rear holder' rear portion from being lifted. With the above structure, in mounting the rear holder i on the housing a, the terminal locking projections h are inserted into the housing a through the rear holder engagement openings f and moved forwardly, driving terminal lugs c in an incompletely inserted position to a position where the lugs c are engaged with resilient locking arms d (FIG. 16).

In the above prior art, however, the rear holder i may be fitted on the housing a only after insertion of terminal lugs c into the housing a is completed. As a result, hinge straps j remain largely extended outwardly during transportation and easily get entangled with each other, causing damages to the hinge straps j and rear holders i.

SUMMARY OF THE INVENTION

The present invention has been accomplished to overcome the above drawback and one of its objects is to provide a construction in which terminal lugs may be inserted into a housing while a rear holder joined to the housing by lengthy hinge straps is kept on the housing in a preliminarily engaged state, thereby making it possible for the rear holder to be retracted during transportation and the like, and preventing the damages resulting from the entanglement of rear holders.

In order to attain the above object, according to the present invention, there is provided an electrical connector with a rear holder comprising: a connector housing; a plurality of terminal accommodating chambers formed in the connector housing, each containing a resilient locking piece for preventing a terminal lug inserted therein from rearwardly slipping off; an opening extending to each of the terminal accommodating chambers, formed in an outer peripheral wall of the connector housing; a rear holder integrally joined to the connector housing by at least one hinge strap and including a number of terminal locking projections corresponding to and insertable into the openings; and engagement means provided on the connector housing and on the rear holder, engageable with each other to have the rear holder mounted on the outer peripheral wall of the connector housing, the engagement means including means for having the rear holder mounted in a preliminarily engaged state and means for having the rear holder mounted in a fully engaged state, wherein when the rear holder is in the preliminarily engaged state, the terminal locking projections are located out of movement paths of the terminal lugs in the terminal accommodating chambers and when the rear holder is in the fully engaged state, the terminal locking projections are located in the movement paths of the terminal lugs.

According to another aspect of the present invention, there is provided an electrical connector with a rear holder comprising: a connector housing; a plurality of terminal accommodating chambers formed in the connector housing, each containing a resilient locking piece for preventing a terminal lug inserted therein from rearwardly slipping off; an opening extending to each of the terminal accommodating chambers, formed in an outer peripheral wall of the connector housing; a rear holder comprised of a frame member and a main plate hingedly connected upright to the frame member in a foldable manner, the rear holder being integrally joined to the connector housing by at least one hinge strap provided between the frame member and the connector housing, the main plate including a number of terminal locking projections corresponding to and insertable into the openings; engagement means provided on the connector housing and on the frame member of the rear holder, engageable with each other to have the rear holder mounted on the outer peripheral wall of the connector housing; and means for holding the main plate in a folded state, wherein when the rear holder is mounted on the outer peripheral wall of the connector housing with the main plate held in the folded state, the terminal locking projections enter the terminal accommodating chambers through the openings to be located in movement paths of the terminal lugs.

In operation, the rear holder, which is integrally connected to the connector housing by hinge straps, is selectively moved, through the engagement means, between a preliminarily engaged position and a fully engaged position on the outer peripheral wall of the connector housing.

DETAILED DESCRIPTION OF THE PREFERRED EMBODIMENTS

Figure 1:
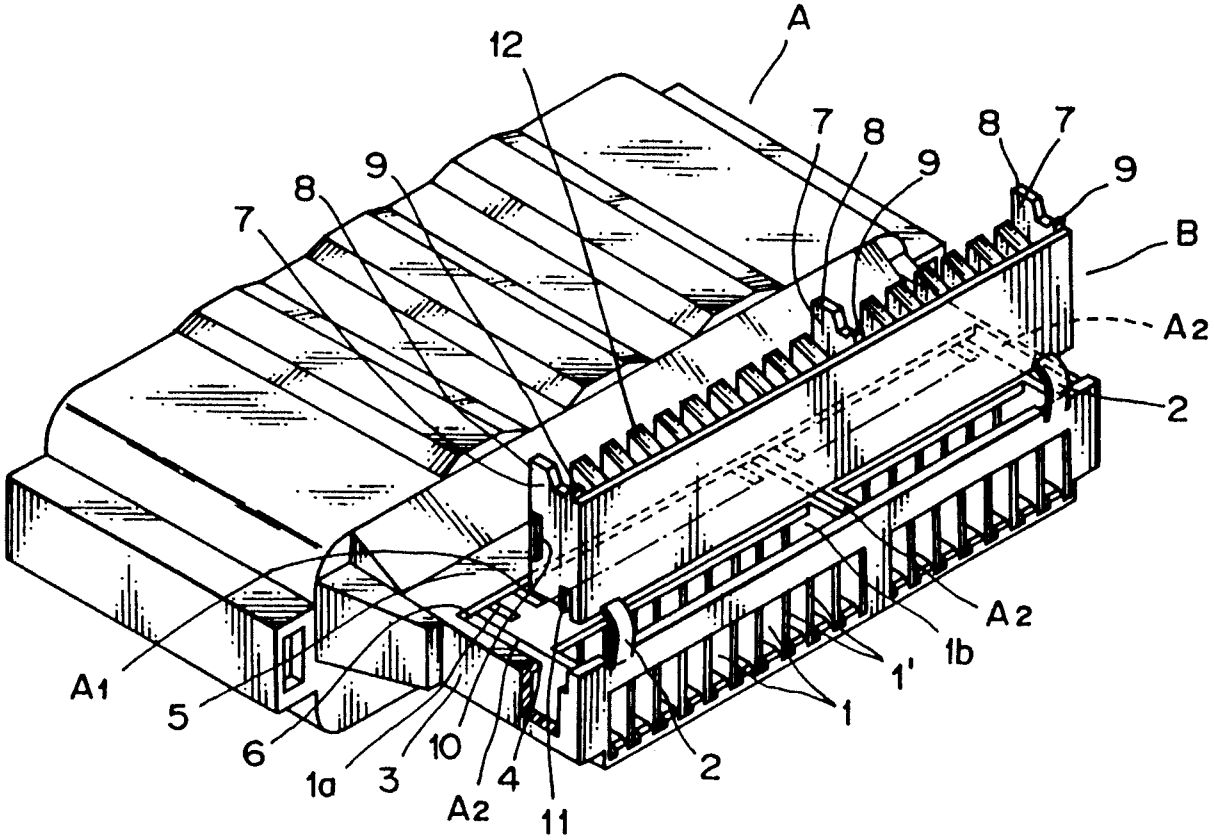
FIG. 1 is a perspective view of a connector housing and a rear holder as one embodiment of the invention shown disengaged from each other.

Embodiments of this invention will now be described with reference to the attached drawings.

Referring to FIGS. 1 to 6, a plurality of laterally arranged terminal accommodating chambers 1 are formed in a synthetic resin-made connector housing A. A plate-like rear holder B is integrally joined to the upper surface at the rear end of the connector housing A by means of resiliently elastic hinge straps 2, and a series of accommodating recesses A1 are formed in the upper surface at a rear portion of the connector housing A for accommodation of the rear holder B.

The accommodating recesses A1 include at a front portion thereof upward openings 1*a* of the respective terminal accommodating chambers 1 and at a rear portion thereof a transverse common opening 1*b* formed in the partition walls 1' for the terminal accommodating chambers 1.

The accommodating recesses A1 further include on both lateral sides and at an intermediate portion front-to-back extending guide grooves A2 for facilitating the fitting of the rear holder B on the connector housing A. The lateral side walls 3 of the connector housing A facing the guide grooves A2 are each provided at their upper ends with inwardly directed engagement portions 4, and the upper wall 5, which forms part of the outer peripheral wall of the connector housing A, is provided at portions thereof facing the guide grooves A2 with engagement portions 6.

The rear holder B has, on the inner surface at both lateral ends and at an intermediate portion, front-to-back extending guide plates 7 for facilitating the fitting of the rear holder B on the connector housing A. The guide plates 7 each include at their front ends guide projections 8 and full engagement projections 9 engageable with the engagement portions 6. The guide plates 7 located on the lateral sides of the rear holder B each have, at a lower portion on the surfaces opposed to the side walls 3, preliminary engagement projections 10 and, at an upper portion, full engagement projections 11. Further, the inner surface of the rear holder B includes, at a front portion thereof, a plurality of first terminal locking projections 12 in alignment with the respective upward openings 1*a* of the terminal accommodating chambers 1 and, at a rear portion thereof, a laterally extending second terminal locking projection 13 insertable into the common opening 1*b*.

Figure 2:
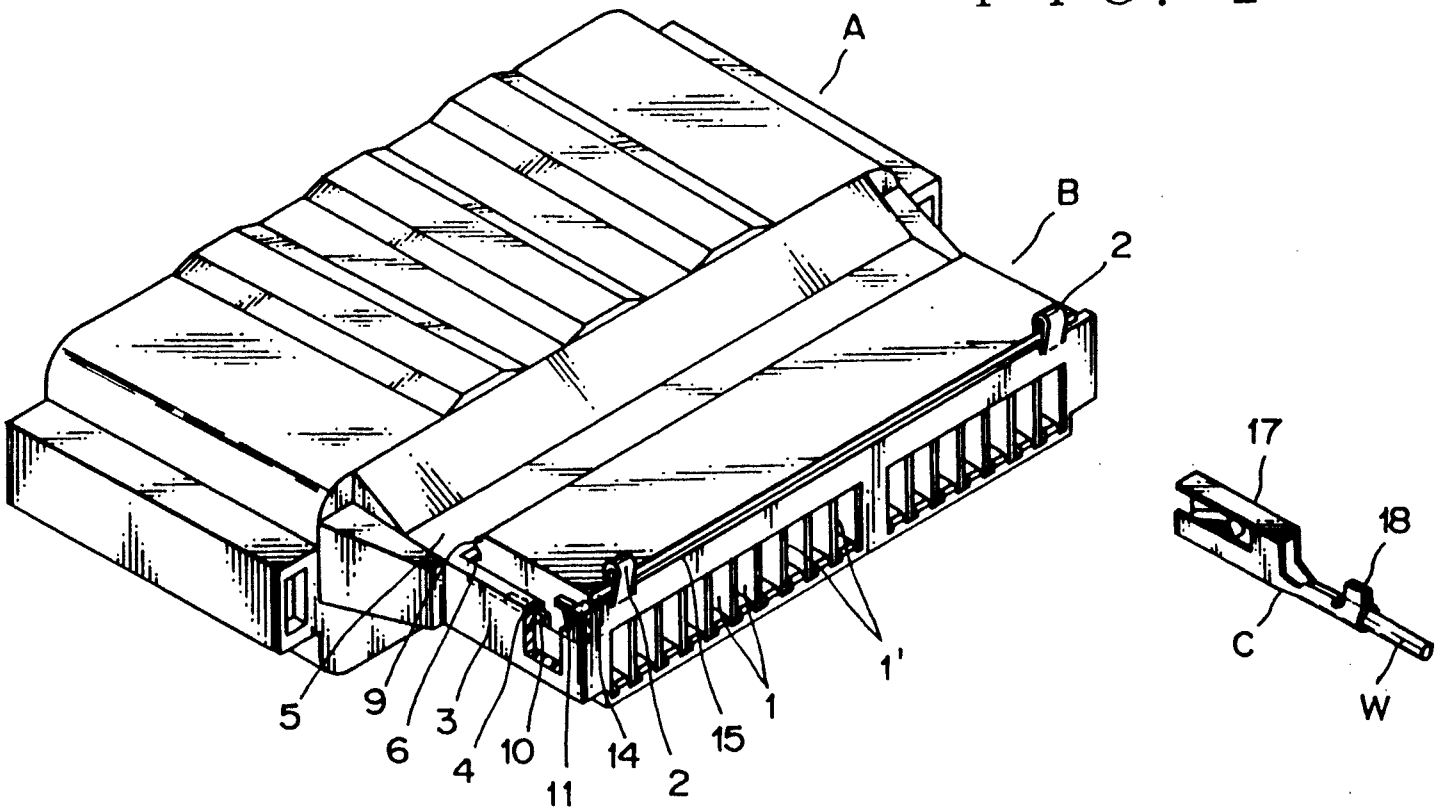
FIG. 2 is a partially cutaway perspective view of the connector housing and the rear holder in a preliminarily engaged state.
Figure 4:
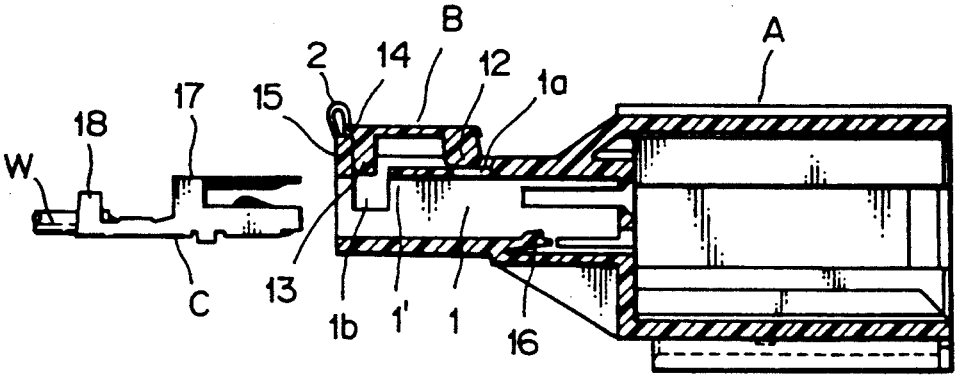
FIG. 4 is a sectional view of the connector housing and the rear holder in the preliminarily engaged state.
Figure 5:
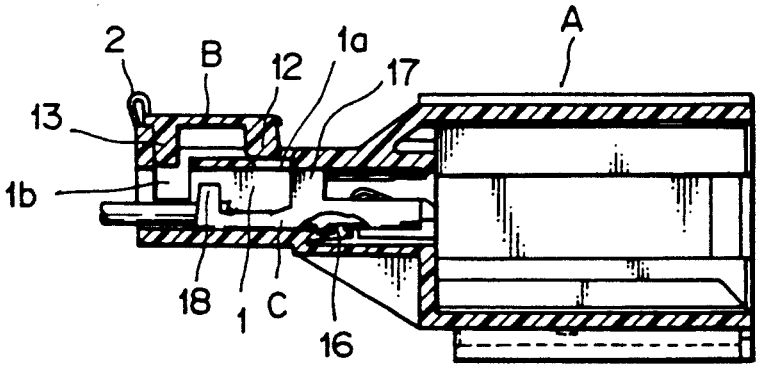
FIG. 5 is a sectional view of the connector housing and the rear holder in the preliminarily engaged state, with a terminal lug inserted in the connector housing.

In the above construction, the rear holder B is mounted on the connector housing A first in a preliminary engaged state (FIGS. 2 and 4). In the preliminarily engaged state, the preliminarily engagement projections 10 of the rear holder B engage the engagement portions 4 of the connector housing A, while a step portion 14 rearwardly of the second terminal locking projection 13 rests on the upper end of a rear wall 15 of the connector housing A. In the preliminarily engaged state, the first and second terminal locking projections 12 and 13 of the rear holder B are located out of insertion paths of terminal lugs C in the connector housing A, thereby allowing terminal lugs C, attached to wires W in advance, to be inserted into the respective terminal accommodating chambers 1 and firstly locked by resilient locking pieces 16 (FIG. 5).

Figure 3:
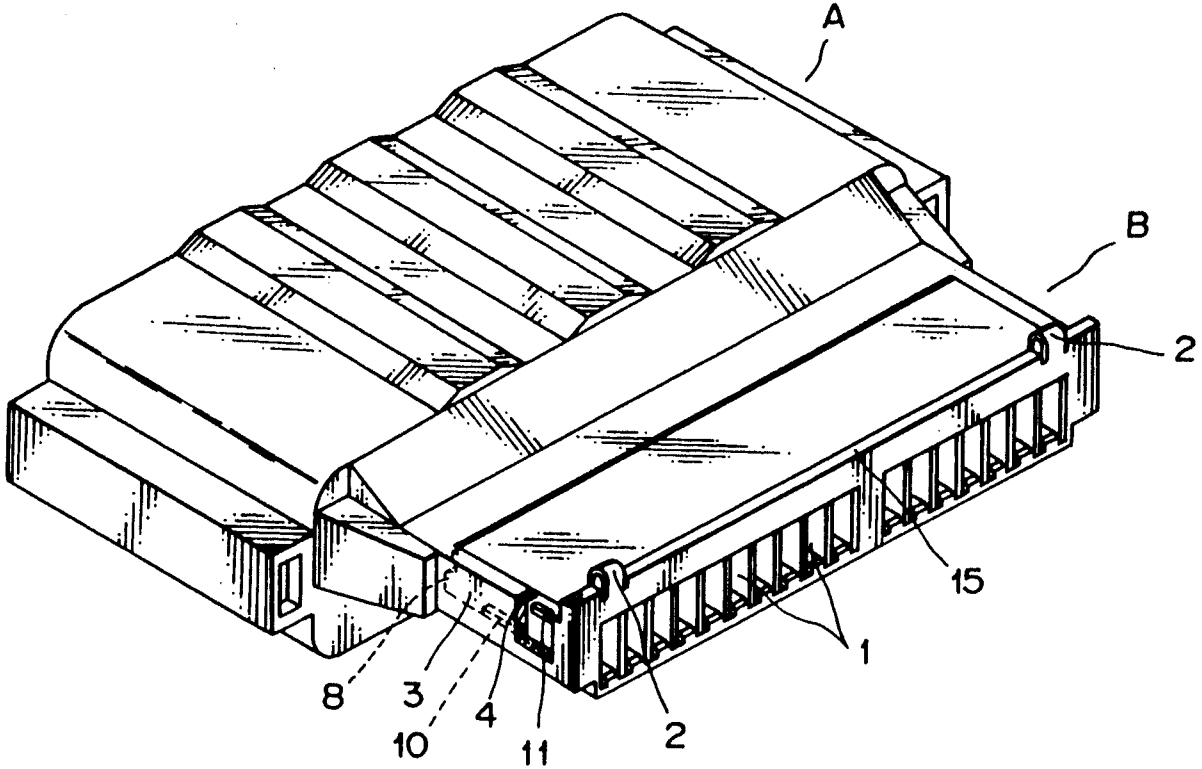
FIG. 3 is a partially cutaway perspective view of the connector housing and the rear holder in a fully engaged state.
Figure 6:
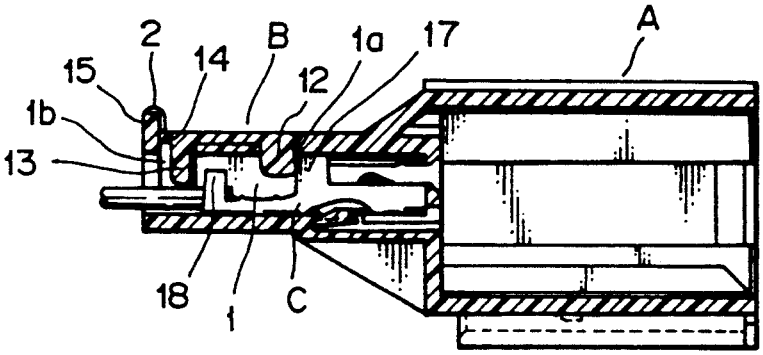
FIG. 6 is a sectional view of the connector housing and the rear holder in the fully engaged state.
Figure 7:
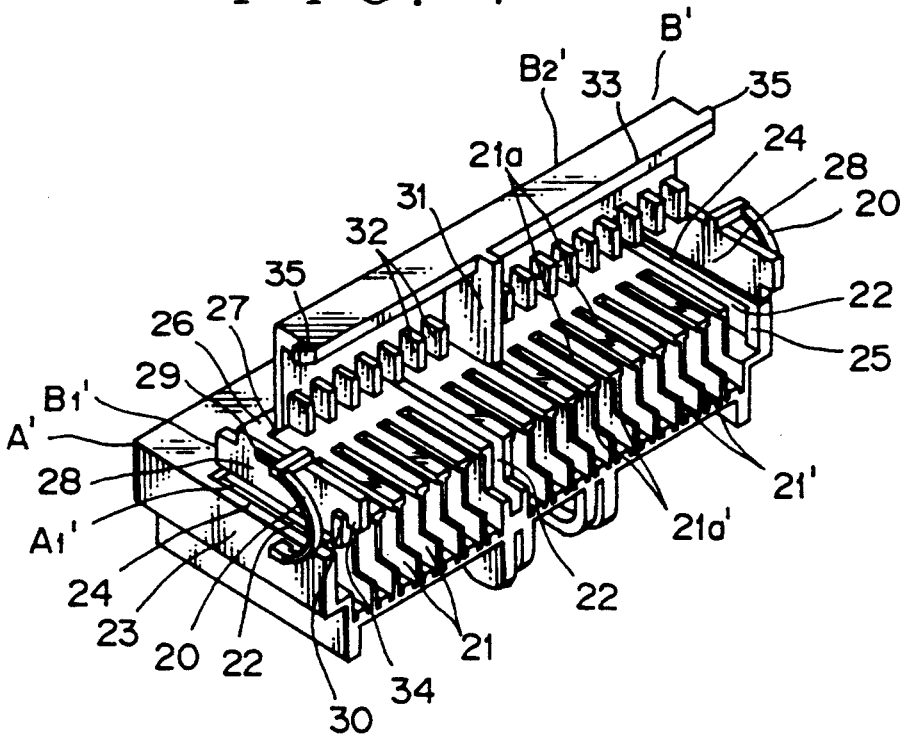
FIG. 7 is a perspective view of a connector housing and a rear holder as another embodiment of the invention shown disengaged from each other.

After terminal lugs C are inserted into the terminal accommodating chambers 1, the rear holder B is pressed downwardly and forwardly so that its front and rear full engagement projections 9 and 11 engage the engagement portions 6 and 4, respectively, to hold the rear holder B in a fully engaged state with the connector housing A (FIGS. 3 and 6).

In the fully engaged state, the first terminal locking projections 12 of the rear holder B are located rearwardly of the electrical contact portions 17 of the terminal lugs C, and the second terminal locking projection 13 is located rearwardly of the stabilizers 18, thereby locking the terminal lugs C against slipping off from the rear of the terminal accommodating chambers 1.

When it becomes necessary to replace terminal lugs C, the rear holder B is brought up into a preliminary engaged state, and then the replacement is effected.

Referring now to FIGS. 7 to 13, a rear holder B' is integrally joined to the upper surface at the rear end of a synthetic resin-made connector housing A' by means of resiliently elastic hinge straps 20. Accommodating recesses A1' are formed in the upper surface at a rear portion of the connector housing A' for accommodating the rear holder B'. The accommodating recesses A1' include a plurality of upper openings 21*a* of the terminal accommodating chambers 21 which are also open at their rear ends, and a cutaway portion 21*a*' formed at the rear end of the partition walls 21' for the terminal accommodating chambers 21.

The accommodating recesses A1' further include on both lateral sides and at an intermediate portion front-to-back extending guide grooves 22 for facilitating the fitting of the rear holder B' on the connector housing A'. The lateral side walls 23 of the connector housing A' facing the guide grooves 22 are each provided at their upper and rear ends with inwardly directed engagement portions 24 and 25, respectively.

The rear holder B' is composed of a clamp-shaped frame member B1', to which one end of the hinge straps 20 is attached, and a main plate B2' connected upright, by a hinge portion 27, in a foldable manner to the frame member B1' at the intermediate laterally extended portion 26 thereof. The clamp-shaped frame member B1' includes on both lateral sides guide plates 28 which enter the guide grooves 22, the guide plates 28 each having, at an intermediate portion thereof, preliminary engagement projections 29 engageable with the respective engagement portions 24 and, at their rear end, first full engagement projections 30 engageable with the engagement portions 25.

The main plate B2' has on the inner surface at an intermediate portion a guide plate 31 that enters the intermediate guide groove 22 and at a front portion a plurality of first terminal locking projections 32 in alignment with the upper openings 21*a* of the terminal accommodating chambers 21. At the rear end of the main plate B2' is provided a laterally extended second terminal locking projection 33 which is to be positioned in the cutaway portion 21*a*'. The second terminal locking projection 33 includes at both its lateral ends second full engagement projections 35 for engagement with engagement portions 34 formed at a lower portion of the rear end of the guide plates 28.

Figure 8:
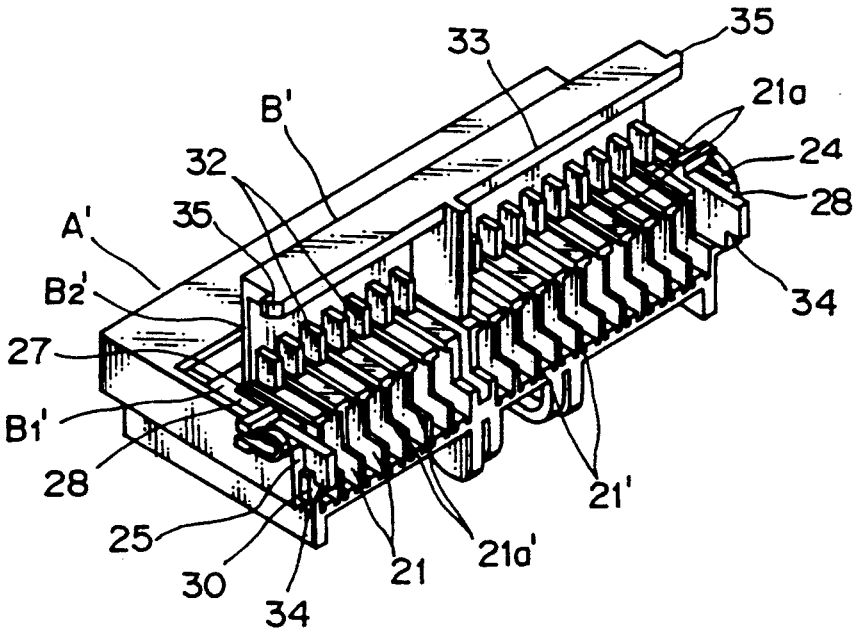
FIG. 8 is a perspective view of the connector housing and the rear holder in a preliminarily engaged state.
Figure 10:
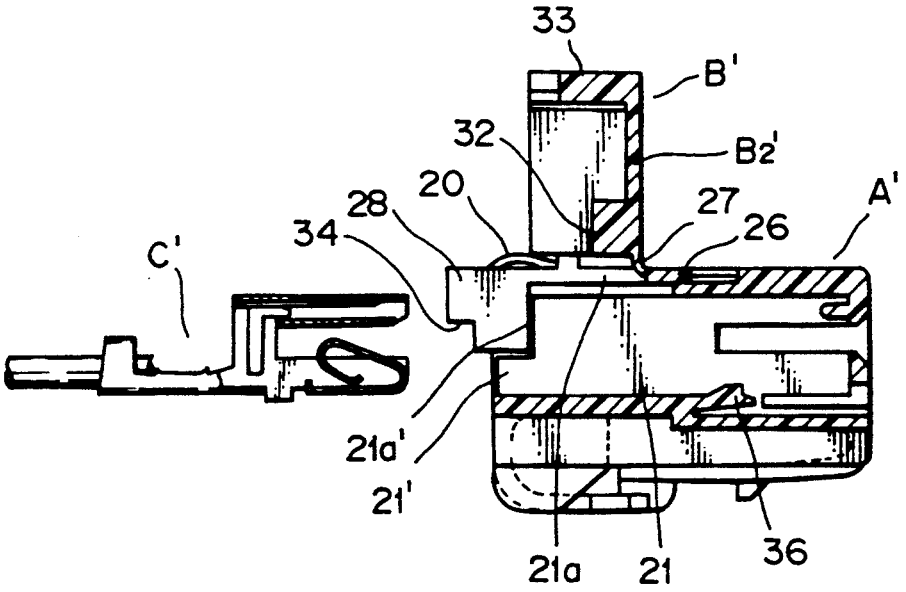
FIG. 10 is a sectional view of the connector housing and the rear holder in the preliminarily engaged state.

In the above construction, the rear holder B' is brought into a preliminarily engaged state with the connector housing A' by moving the guide plates 28 of the rear holder B' into the guide grooves 22 of the connector housing A' and allowing the preliminary engagement projections 29 to be engaged with the engagement portions 24 of the side walls 23 (FIGS. 8 and 10).

Figure 11:
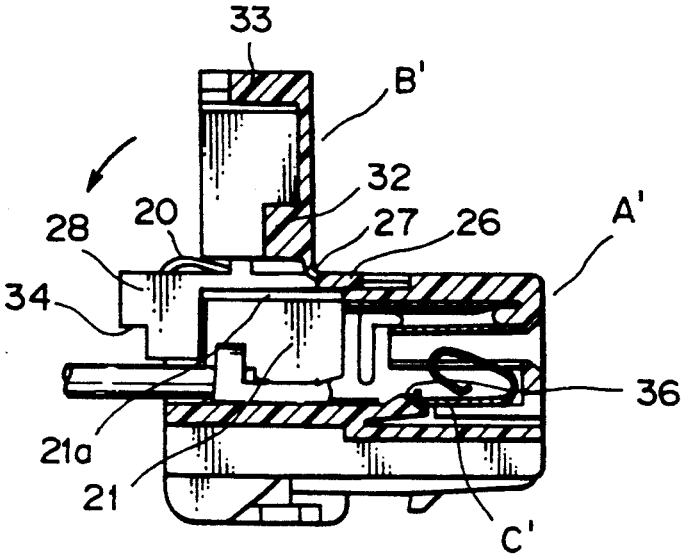
FIG. 11 is a sectional view of the connector housing and the rear holder in the preliminarily engaged state, with a terminal lug inserted in the connector housing.

In the preliminarily engaged state, the main plate B2' of the rear holder B' is urged to assume an upright attitude by the nature of the hinge portion 27, and thus terminal lugs C' may be inserted into the terminal accommodating chambers 21 to be firstly locked by the resilient locking pieces 36 against rearwardly slipping off (FIG. 11).

Figure 9:
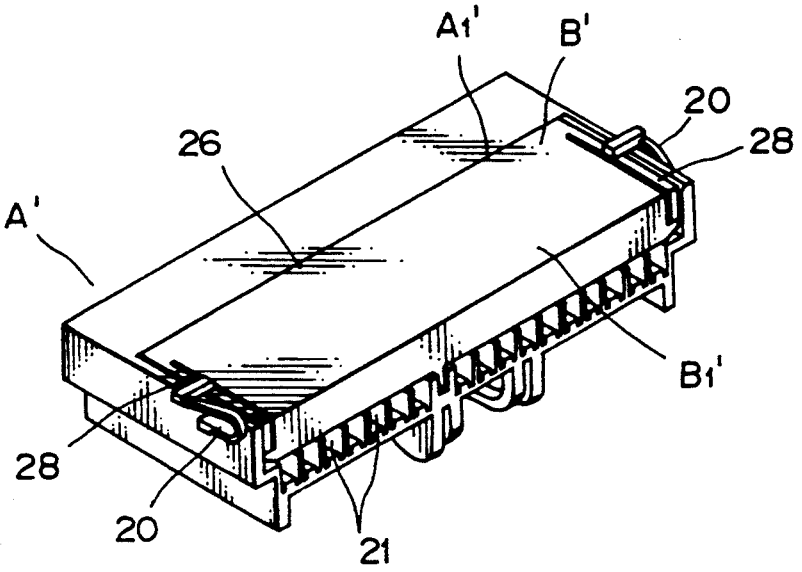
FIG. 9 is a perspective view of the connector housing and the rear holder in a fully engaged state.
Figure 12:
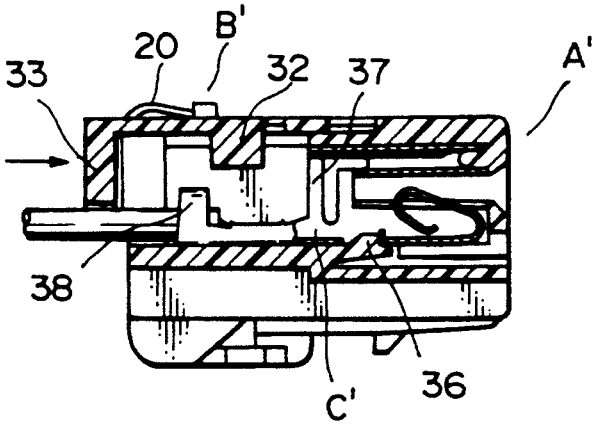
FIG. 12 is a sectional view of the connector housing and the rear holder at a stage of moving into the fully engaged state.
Figure 13:
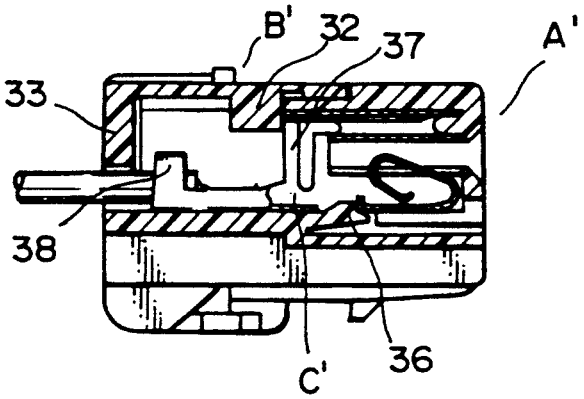
FIG. 13 is a sectional view of the connector housing and the rear holder in the fully engaged state.
Figure 14:
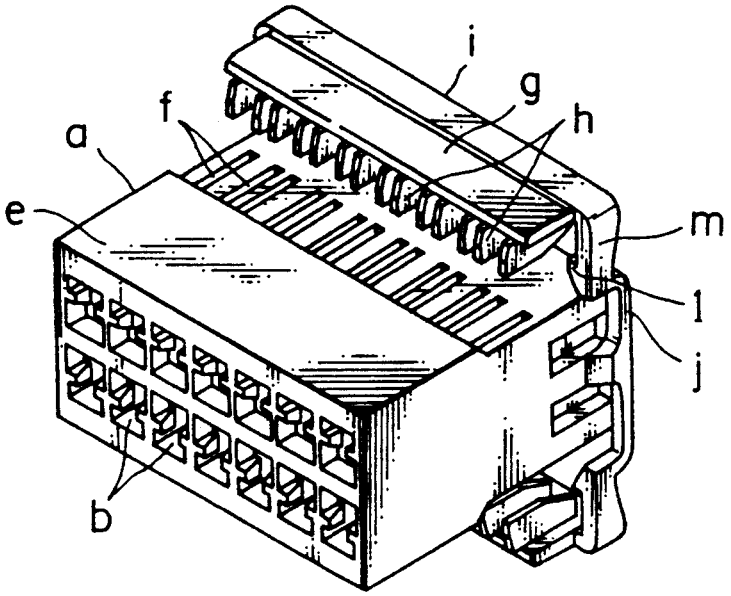
FIG. 14 PRIOR ART
FIG. 14 is a perspective view of a conventional connector housing with a rear holder disengaged therefrom.
Figure 15:
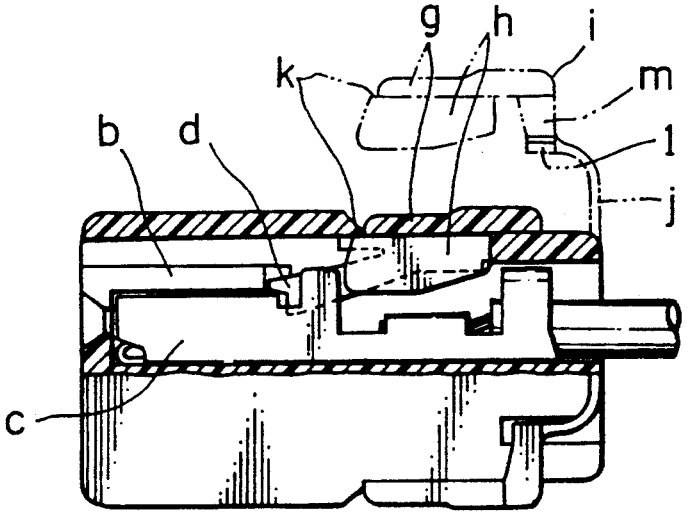
FIG. 15 PRIOR ART
FIG. 15 is a sectional view of the conventional connector housing and the rear holder in an engaged state.
Figure 16:
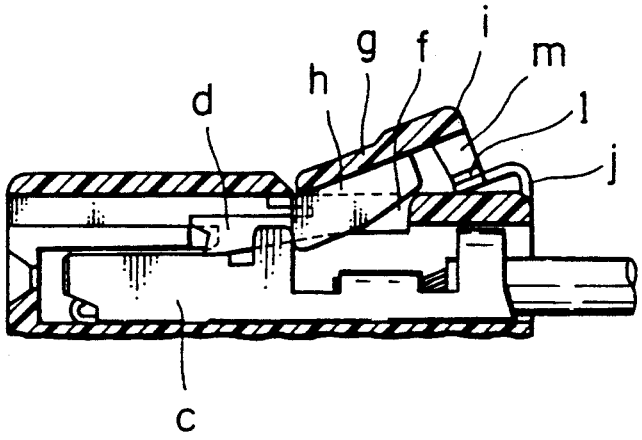
FIG. 16 PRIOR ART
FIG. 16 is a sectional view of the rear holder at a stage of engagement with the connector housing.

Thereafter, the main plate B2' is folded to cause insertion of the first terminal locking projections 32 into the respective terminal accommodating chambers 21 and to bring the second full engagement projections 35 into engagement with the engagement portions 34 of the guide plates 28 and the second terminal locking projection 33 to a position rearwardly of the terminal accommodating chambers 21 (FIG. 12). Then, the rear holder B' is as a whole pushed forward so that the first full engagement projections 30 are engaged with the engagement portions 25 to bring the rear holder B' in a fully engaged state with the connector housing A' (FIGS. 9 and 13).

In the fully engaged state, the first terminal locking projections 32 are located rearwardly of the electrical contact portions 37 of the terminal lugs C' and the second terminal locking projection 33 is located rearwardly of the stabilizers 38.

As mentioned above, according to the present invention, a rear holder integrally connected to a connector housing by hinge straps is fitted on an outer peripheral wall of the connector housing in two steps of a preliminarily engaged state and a fully engaged state, and terminal lugs are moved into and out of the terminal accommodating chambers in the preliminarily engaged state. The above structure leads to prevention of damages to the hinge straps and the rear holders during transportation and the like and provides an enhanced convenience in handling.

What is claimed is:

1. An electrical connector with a rear holder comprising:

a connector housing;

a plurality of terminal accommodating chambers formed in the connector housing, each containing a resilient locking piece for preventing a terminal lug inserted therein, through an insertion hole substantially axially aligned therewith, from rearwardly slipping off;

an opening extending to each of the terminal accommodating chambers, formed in an outer peripheral wall of the connector housing, the opening communicating with the associated accommodating chamber substantially perpendicularly to a longitudinal axis of the accommodating chamber at a position intermediate the length thereof;

a rear holder integrally joined to the connector housing by at least one hinge strap and including a number of terminal locking projections corresponding to and insertable into the openings; and engagement means provided on the connector housing and on the rear holder, engageable with each other to have the rear holder mounted on the outer peripheral wall of the connector housing, the engagement means including means for having the rear holder mounted in a preliminarily engaged state and means for having the rear holder mounted in a fully engaged state, wherein when the rear holder is in the preliminarily engaged state, the terminal locking projections are located out of movement paths of the terminal lugs in the terminal accommodating chambers and when the rear holder is in the fully engaged state, the terminal locking projections are located in the movement paths of the terminal lugs.

2. An electrical connector with a rear holder according to claim 1, wherein the engagement means provided on the rear holder comprises projections.

3. An electrical connector with a rear holder according to claim 1, wherein the openings formed in the outer peripheral wall of the connector housing are arranged in a row and the terminal locking projections are correspondingly arranged in a row.

4. An electrical connector with a rear holder according to claim 3, wherein the rear holder further comprises a laterally extended continuous second terminal locking projection provided on its inner surface at a predetermined distance from and in parallel with the terminal locking projections, the second terminal locking projection being insertable into the terminal accommodating chambers through a cutaway portion formed in partition walls for the terminal accommodating chambers so that when the rear holder is in the fully engaged state, the second terminal locking projection is located in the movement paths of the terminal lugs.

5. An electrical connector with a rear holder comprising:

a connector housing;

a plurality of terminal accommodating chambers formed in the connector housing, each containing a resilient locking piece for preventing a terminal lug inserted therein from rearwardly slipping off;

an opening extending to each of the terminal accommodating chambers, formed in an outer peripheral wall of the connector housing;

a rear holder comprised of a frame member and a main plate hingedly connected upright to the frame member in a foldable manner, the rear holder being integrally joined to the connector housing by at least one hinge strap provided between the frame member and the connector housing, the main plate including a number of terminal locking projections corresponding to and insertable into the openings;

engagement means provided on the connector housing and on the frame member of the rear holder, engageable with each other to have the rear holder mounted on the outer peripheral wall of the connector housing; and means for holding the main plate in a folded state, wherein when the rear holder is mounted on the outer peripheral wall of the connector housing with the main plate held in the folded state, the terminal locking projections enter the terminal accommodating chambers through the openings to be located in movement paths of the terminal lugs.

6. An electrical connector with a rear holder according to claim 5, wherein the engagement means for having the rear holder mounted on the outer peripheral wall of the connector housing includes means for having the rear holder mounted in a preliminarily engaged state and means for having the rear holder mounted in a fully engaged state, and wherein the main plate is held in the folded state in the fully engaged state.

7. An electrical connector with a rear holder according to claim 5, wherein the engagement means provided on the rear holder comprises projections.

8. An electrical connector with a rear holder according to claim 5 or 6, wherein the main plate is held in the folded state by projections provided thereon, engageable with corresponding engagement portions provided on the frame member of the rear holder.

9. An electrical connector with a rear holder according to claim 5, wherein the openings formed in the outer peripheral wall of the connector housing are arranged in a row and the terminal locking projections are correspondingly arranged in a row.

10. An electrical connector with a rear holder according to claim 9, wherein the main plate of the rear holder further comprises a laterally extended continuous second terminal locking projection provided on its inner surface at a predetermined distance from and in parallel with the terminal locking projections, the second terminal locking projection being insertable into the terminal accommodating chambers through a cutaway portion formed in partition walls for the terminal accommodating chambers so that when the rear holder is mounted on the outer peripheral wall of the connector housing with the main plate held in the folded state, the second terminal locking projection is located in the movement paths of the terminal lugs.

* * * * *